United States Patent [19]

Trusselle et al.

[11] 4,350,187

[45] Sep. 21, 1982

[54] FILLING MACHINE

[75] Inventors: William H. Trusselle, Braintree; John A. Gustafson, Jr., Wollaston, both of Mass.

[73] Assignee: Pneumatic Scale Corporation, Quincy, Mass.

[21] Appl. No.: 162,899

[22] Filed: Jun. 25, 1980

[51] Int. Cl.[3] ..... B65B 3/04; B08B 3/02

[52] U.S. Cl. ..... 141/90; 134/198; 141/91; 222/148

[58] Field of Search ..... 141/129–191, 141/85–92, 93, 392, 70, 1; 134/105, 166 C, 198; 222/148, 150; 34/107, 155

[56] References Cited

U.S. PATENT DOCUMENTS

| | | | |
|---|---|---|---|
| 3,601,162 | 8/1971 | Page | 141/90 |
| 3,850,207 | 11/1974 | Loliger et al. | 141/90 |
| 3,912,535 | 10/1975 | Rauser | 141/90 |
| 3,926,229 | 12/1975 | Scholle | 141/90 X |
| 3,993,111 | 1/1976 | McLennand | 141/90 |
| 4,024,896 | 5/1977 | Ishioka et al. | 141/90 |
| 4,213,795 | 7/1980 | Ernstsson et al. | 141/90 |
| 4,218,265 | 8/1980 | Fuchs et al. | 141/90 |

*Primary Examiner*—Frederick R. Schmidt
*Attorney, Agent, or Firm*—Robert T. Gammons

[57] ABSTRACT

This invention relates to container filling machines and specifically to cleaning the exterior surface of the filling nozzle of product clinging thereto following the filling operation.

5 Claims, 5 Drawing Figures

FILLING MACHINE

BACKGROUND OF INVENTION

Figure 1:
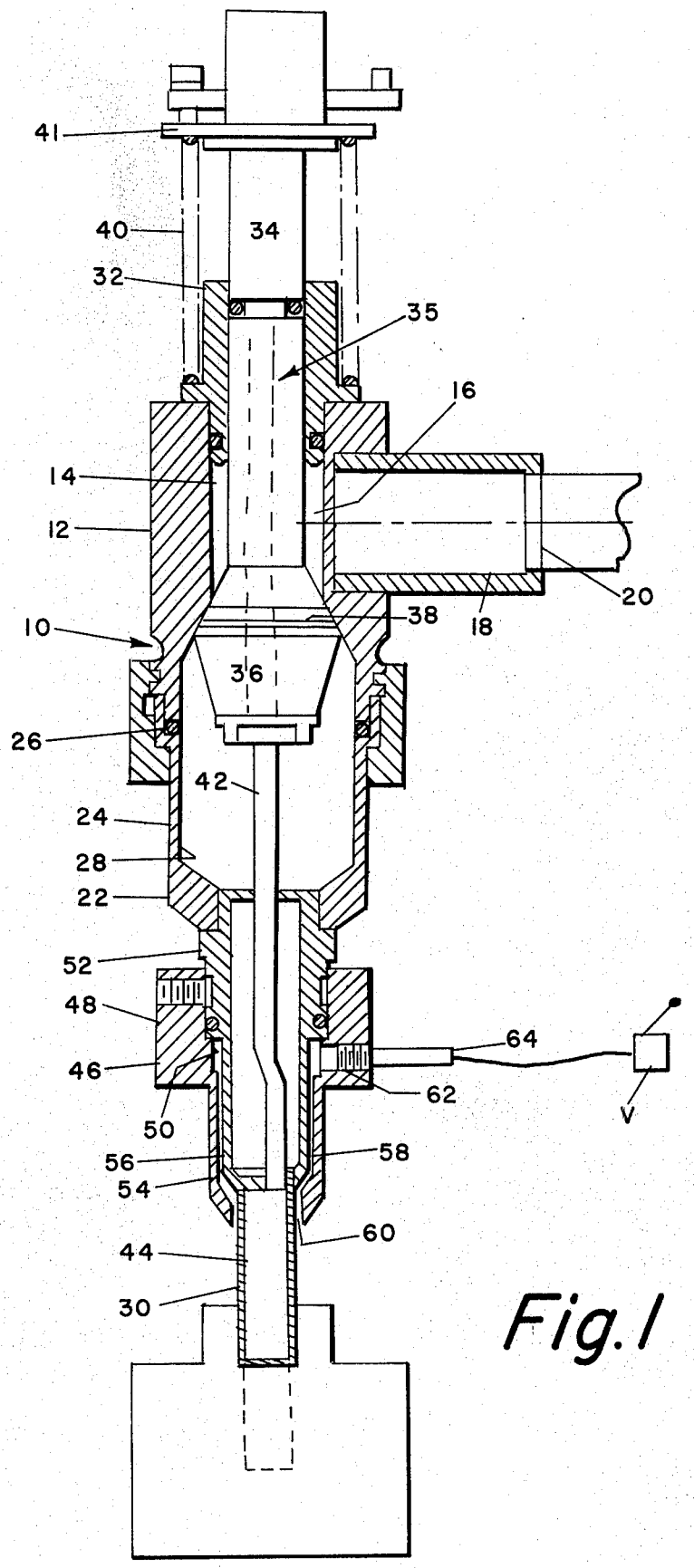

In a container filling machine of, for example, the kind shown in U.S. Pat. Nos. 3,182,691 and 3,207,189 wherein there are filling heads provided with nozzles which are engaged within or above the open tops of the containers during the filling operation, it is customary as part of the operation to clear the interior of the nozzle after it is withdrawn from the container or, alternately, the container has been lowered away from the nozzle by projecting a blast of air through the nozzle. This is provided for by positioning an air pipe within the nozzle to which air is supplied under pressure so as to blow air through the lower end of the nozzle. It has been found that for some filling operations, the product adheres not only to the interior of the nozzle, but also to the exterior surface of the nozzle. If the product is viscous, it tends to string off the nozzle and contaminate the container and threads prior to capping.

Because the outside diameter of the filling nozzle and the inside diameter of the container neck finish provided minimum clearance for the venting of the air in the container, while filling, any buildup of product on the outside of the liquid filling nozzle tended to restrict the air vent, thus producing a back pressure which prematurely shut off the filling process producing a slack filled container.

It is the purpose of this invention to provide for removing the product from the exterior surface of the nozzle during a period when the nozzle is withdrawn from the container and/or the container is withdrawn from the nozzle to clear the exterior surface of the nozzle. If the filling machine is of the rotary type wherein there is means for loading empty containers into the machine for filling and means for discharging filled containers from the machine after filling, the means for clearing the exterior surface of the nozzles are desirably brought into operation during the interval that each filling head is traveling from the place of discharge to the place of loading.

SUMMARY OF INVENTION

As herein illustrated, the filling machine comprises a filling head provided with a filling nozzle and a container support so arranged as to enable positioning the nozzle within the open top of the container during the filling operation and separating the nozzle and container from each other following filling and means associated with the filling nozzle operable when the latter is separated from the container to clear the external surface of the nozzle of product adhering to the exterior surface. The nozzle may be positioned in the open top of the container by lowering the nozzle relative to the container support or by raising the container support relative to the nozzle. The means associated with the nozzle to clear the exterior surface comprises means for projecting a stream of gas downwardly against the exterior surface of the nozzle and this latter means may comprise a manifold disposed about the nozzle containing a gas chamber to which gas is supplied under pressure and means defining an opening concentric with the nozzle through which gas is delivered to the chamber may be directed downwardly on the surface of the nozzle. More specifically, the invention relates to a rotary filling machine where there are a plurality of filling heads movable in a circular path and a plurality of container-elevating members movable into alignment with the filling heads arranged to elevate successive containers into operative positions relative to the filling heads. Each filling head has a liquid supply inlet and an outlet nozzle. The container-elevating members are actuated to engage the nozzles within the open tops of the empty containers as the latter are delivered to the machine and to disengage them from the open tops of the filled containers as they are discharged. The empty containers are delivered to the machine by means of star wheel mechanisms and associated conveyor and discharged therefrom by a star wheel mechanism and associated conveyor, the star wheels being placed peripherally of the path of rotation of the filling heads. The clearing operation is achieved during the interval of travel of a filling head from the star wheel mechanism at the point of discharge of a filled container to the star wheel mechanism at the point of delivery of an empty container. Desirably, at this position, there is a drip pan for receiving the product cleared from the nozzle.

Figure 3:
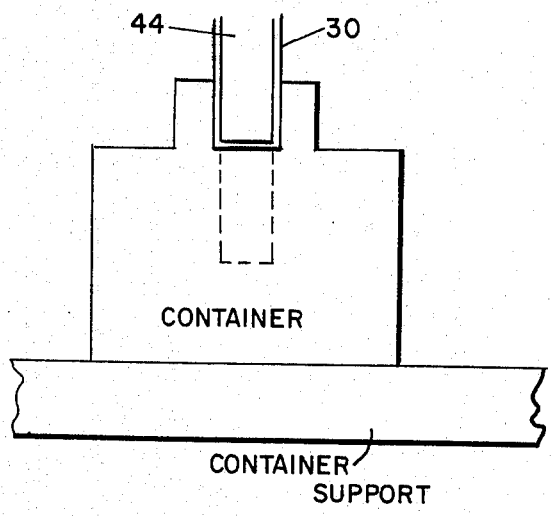
Figure 2:
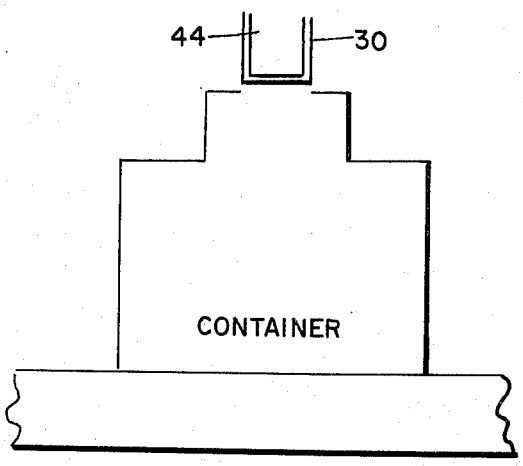
Figure 5:
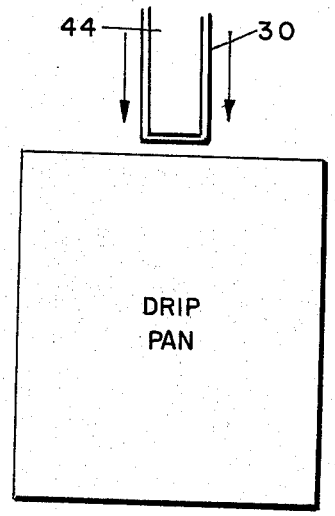
Figure 4:
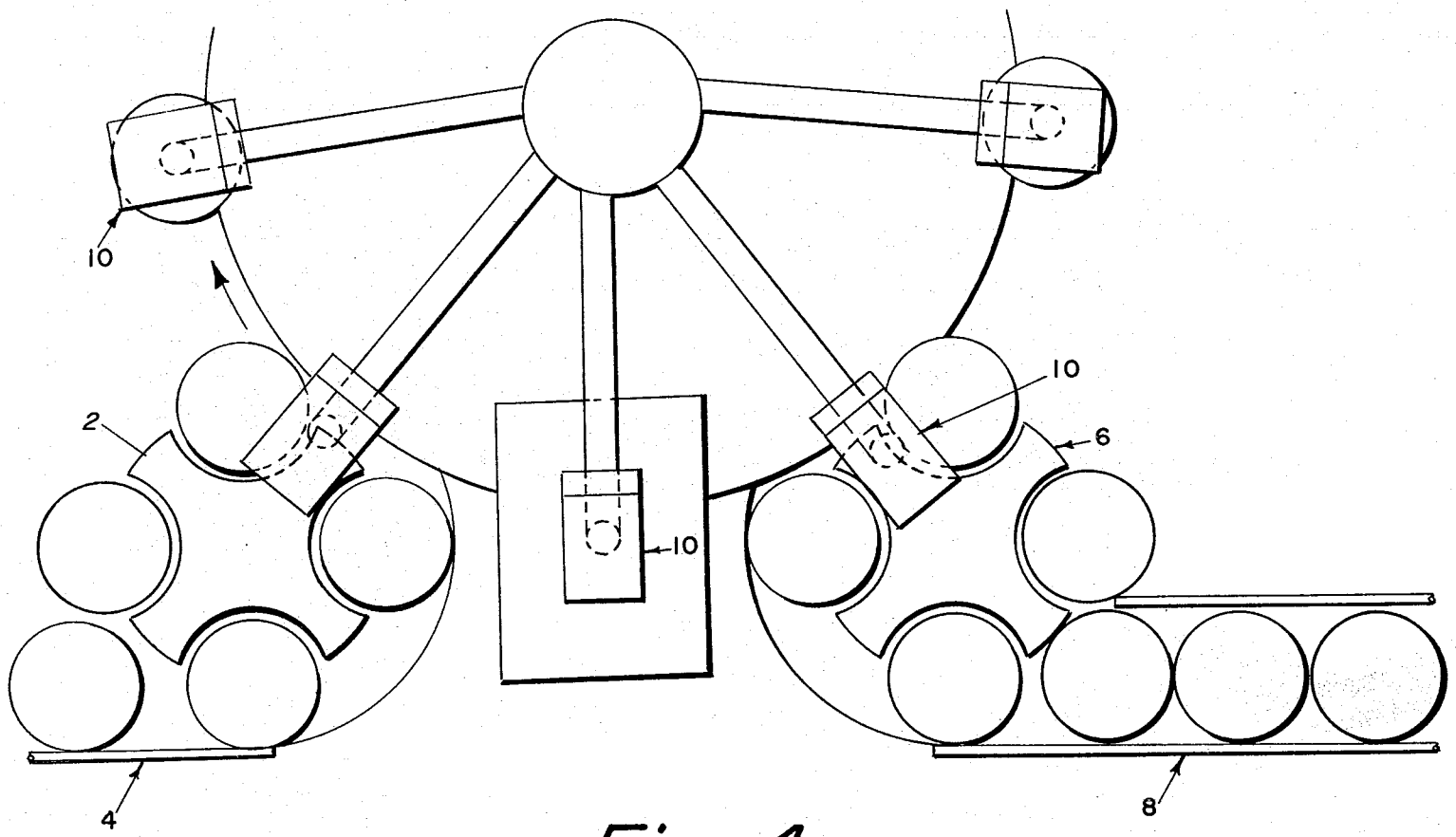

The invention will now be described in greater detail with reference to the accompanying drawings, wherein:

FIG. 1 is a fragmentary front elevation of a container filling machine showing the filling nozzle;

FIG. 2 diagrammatically illustrates the position of the lower end of the filling nozzle prior to the filling operation;

FIG. 3 diagrammatically illustrates the position of the lower end of the filling nozzle during filling;

FIG. 4 is a fragmentary plan view of the star wheel mechanisms with a drip pan located therebetween; and FIG. 5 is an elevation of a drip pan positioned below a nozzle traveling across the gap from one star wheel to the other.

As previously related, the container-filling apparatus as herein illustrated is similar to the container filling machines shown, for example, in U.S. Pat. Nos. 3,182,691 and 3,207,189 wherein a plurality of filling heads are moved circularly about a common center and there is means for moving empty containers to be filled successively into position beneath the filling heads and successively removing the filled containers from beneath the filling heads. In the aforesaid patented structures, each filling head 10 comprises a hollow cylindrical block 12 provided with a chamber 14 having an inlet 16. A nipple 18 connects the chamber with a liquid supply conduit 20. Each hollow nozzle block 12 is supported by a bracket not shown which is secured to a rotary support. The lower end of the nozzle block 12 is provided with a hollow nozzle-carrying portion 24 secured thereto providing a valve chamber 28 in communication with the chamber 14. The lower end of the portion 24 is tapered downwardly and a liquid nozzle assembly 30 is attached to the lower end of the portion 28. The upper end of the nozzle block 12 is provided with an adapter 32 which forms a bearing for a stem 34 of a vertically movable liquid control valve 36. The valve 36 comprises an enlarged portion of the stem and is provided with an O-ring 38 engaged in a peripheral groove in the enlarged portion. The valve 36 is freely movable in the chamber 28 and, in operation when the valve is moved upwardly, the enlarged diameter portion of the valve 36 and the O-ring 38 enter into sealing engagement with the wall of the chamber 28 to cut off the flow of liquid into the nozzle. A relatively heavy spring 40 interposed between the upper surface of the nozzle block 12 and a collar 41 carried by the upper portion of the stem 34 urges the valve 38 upwardly into its closed position. The lower end of the valve 36 is tapered downwardly and is provided with a relatively small diameter tubular extension or gas nozzle 42 connected thereto by an adapter. The gas nozzle 42 is connected by a passage extending upwardly through the nozzle 36 and through a passage 35 formed in the valve stem which, in turn, is connected through a side wall opening to a low pressure gas line. The lower end of the gas nozzle 42 extends into the liquid nozzle 30 to its lower end and between the inner side of the liquid nozzle and the gas nozzle there is an annular space through which liquid can flow downwardly from the chamber 28 to the lower end of the liquid nozzle. A valve sleeve 44 is secured to the lower end of the gas nozzle and normally closes the lower end of the liquid nozzle until it is extended therefrom. When the valve 36 is moved downwardly to its open position, it permits the fluid in the chamber 14 supplied thereto from the conduit 20 to flow into the chamber 28. The gas nozzle 42, together with a valve sleeve 44 attached to its lower end, is telescopically extended from the liquid nozzle by the downward movement of the valve 36 and such extension permits flow of the liquid from the chamber 28 through the liquid nozzle into the container supported therebelow, the container being supported on a container support provided for this purpose. Low pressure air flows through the gas nozzle constantly during the filling operation and when the container becomes substantially filled with liquid, the back pressure developed at the lower end of the gas nozzle operates to close the valve 36 and to effect separation of the liquid nozzle from the container.

Empty containers are moved onto container supports traveling circularly with the filling heads by means of a star wheel mechanism 2 to which the empty containers are supplied by a conveyor 4 and the filled containers are removed from the container supports by a star wheel mechanism 6 provided with a conveyor 8 for discharging the filled containers. The star wheels are arranged peripherally of the path of movement of the filling heads so that there is a gap between them within which there is positioned a drip pan. While a filling head is traveling across the gap from the star wheel which removes containers from the machines to the star wheel which supplies containers to the machine, high pressure gas is supplied to the gas nozzle to clear the exterior thereof of liquid. All of this is disclosed in the aforesaid patents.

As previously related, the liquid nozzle 30 is situated within the container during the filling operation so that the product tends to adhere to the external surface of the nozzle. The product thus adhering, as previously mentioned,tends to string off the lower end of the nozzle, thus contaminating the container and threads and, further, to block escape of gas during the filling operation and thus bringing about premature shut-off. To eliminate this, means 46 is provided for removing the product from the exterior surface of the nozzle 30 after the nozzle has been removed from the filled container and before it is reintroduced into an empty container for filling. The means 46 provides for clearing the exterior surface of the nozzle by blowing gas downwardly about the exterior surface of the nozzle during the interval of time that the nozzle is withdrawn from a filled container at the place of discharge and the time that it is reintroduced into a container at the place of delivery of the containers to the machine. This occurs, as shown in the aforesaid patents and herein in FIG. 4 in the space provided between the star wheels 2 and 6 which move containers into positions on the supports for carrying them around from the point of delivery of the containers to the machine to the point of discharge therefrom so that it gravitates together with liquid blown from within the nozzle into the drip pan. The means 46 comprise a manifold block 48 containing a central opening 50 for receiving the nozzle 30 mounted about the nozzle so that the latter is concentric with respect to the opening 50 and secured to the lower end of the portion 24 by an adapter 52. The manifold block has a hollow extension 54 arranged concentrically about an extension 56 of the adapter so that the two in combination define an annular passage 58, the lower end of which defines a conical discharge opening 60 through which gas delivered into the annular passage can be directed downwardly against the outer surface of the nozzle. Gas is delivered under pressure to this annular space through a port 62 formed in the manifold block. At the point in the operation of the machine wherein the gas nozzle 30 has been removed from the container and the filling head is moved from the place of discharge of the filled containers toward the place of delivery of empty containers, gas is supplied to the annular passage and from thence through the discharge opening 60 downwardly onto the exterior surface of the nozzle.

The apparatus operates in the same manner as that shown in the aforesaid patents to deliver the product to the containers as they are traveling circularly from the point of delivery of empty containers to the machine to the point of discharge of filled containers therefrom. Hence, a detailed description of such operation is not considered necessary for a complete understanding of the novel aspect of the instant invention. When a filled container reaches the point of discharge and is withdrawn from the container either by lowering the container or by raising the nozzle or both by lowering the container and raising the nozzle, control means actuated by the moving filling head supplied gas through a suitable conduit 64 to the manifold block for a sufficient length of time to clear the exterior surface of the nozzle. This is accomplished within the period that the nozzle travels from the place of discharge to the place of delivery.

The gas supplied to the manifold for the purpose of clearing the exterior surface of the liquid nozzle may be heated, if desired, to reduce the viscosity of the liquid, if the product is a liquid, and thereby assist in quickly disposing of the adhering product. Further, it is within the scope of the invention to use air in place of gas when such use will not contaminate the product, or to employ a liquid to wash down the exterior surface of the product nozzle.

While the invention has been described with reference to a rotary machine, it is quite clear that it could be used in conjunction with a single filling head or double filling head machine with equally good results by moving the filled container away from the lower end of the nozzle after the nozzle has been separated from the container or the container from the nozzle and thereafter projecting gas downwardly against the external surface of the nozzle.

The primary reason for removing the adhering product is to prevent premature shut-off of the filling nozzle for if the product builds up on the exterior surface of the nozzle, it blocks the escape of gas from the top of the container during the filling operation, thus tripping the shut-off valve. Additionally, by removing the product from the exterior surface of the nozzle prior to succeeding filling operations, contamination of the container is avoided. There is still another advantage derived from providing the aforesaid means for projecting gas downwardly on the exterior surface of the nozzle and that is it provides means for sterilizing the exterior surface of the nozzle. It is to be understood that the term "product" as used herein is intended to cover not only liquid fill but solid fill.

It should be understood that the present disclosure is for the purpose of illustration only and includes all modifications or improvements which fall within the scope of the appended claims.

We claim:

1. In a filling machine, the combination with a filling head provided with a product nozzle and a container support, so arranged as to enable positioning the nozzle within the open top of the container during the filling operation and separating the nozzle and container from each other following the filling operation of means associated with the filling nozzle operable when the latter is separated from the container to clear the external surface of the nozzle of product adhering to said external surface, said means comprising a manifold block positioned about the nozzle in axially fixed relation thereto, said manifold block defining an annular chamber closed at the top and an axially-elongate annular passage extending downwardly from the bottom of the chamber about the nozzle, in concentric relation thereto, the annular passage defining a second nozzle surrounding the product nozzle through which the scavenging fluid delivered under pressure to the chamber is projected forcibly and exclusively downwardly on the external surface of the nozzle and means defining a port in the manifold which enters the manifold radially with respect to the vertical axis of the product nozzle through which a scavenging agent can be delivered under pressure into the chamber.

2. The combination according to claim 1 wherein the scavenging agent is a gas.

3. The combination according to claim 1 wherein the scavenging agent is a fluid.

4. The combination according to claim 1 wherein the scavenging agent is heated.

5. In a filling machine in combination a plurality of filling heads each provided with a product nozzle movable in a circular path, a plurality of container supports movable circularly to position successive empty containers below successive filling heads, means situated in the path of rotation of the filling heads and container supports for delivering empty containers to the supports and discharging filled containers from the supports, there being a space in the path of travel between the said delivery means and discharge means, means operative during the movement of each filling head and container support along said circular path from the place of delivery to the place of discharge to position the product nozzle of each filling head within the open top of a container resting on the container support therebelow for filling and separating the nozzle and container from each other after filling and means operable as the filling head travels from the place of discharge to the place of delivery for clearing the exterior surface of the product nozzle, said means comprising a manifold block positioned about the product nozzle in axially fixed relation thereto, said manifold block defining an annular chamber closed at the top and an axially-elongate annular passage extending downwardly from the bottom of the chamber about the nozzle, the annular passage defining a second nozzle surrounding the product nozzle which forcibly ejects a scavenging agent delivered under pressure to the chamber downwardly on the external surface of the product nozzle toward the lower end of the nozzle and means defining a port in the side wall of the manifold extending radially therethrough into the chamber through which a scavenging agent can be delivered into the chamber.

* * * * *